US006235177B1

(12) United States Patent
Borland et al.

(10) Patent No.: US 6,235,177 B1
(45) Date of Patent: May 22, 2001

(54) METHOD FOR THE CONSTRUCTION OF AN APERTURE PLATE FOR DISPENSING LIQUID DROPLETS

(75) Inventors: Scott Borland, San Mateo; Gary Baker, Mountain View, both of CA (US)

(73) Assignee: Aerogen, Inc., Sunnyvale, CA (US)

( * ) Notice: Subject to any disclaimer, the term of this patent is extended or adjusted under 35 U.S.C. 154(b) by 0 days.

(21) Appl. No.: 09/392,180

(22) Filed: Sep. 9, 1999

(51) Int. Cl.[7] ..... C25D 1/00; C25D 5/02
(52) U.S. Cl. ..... 205/67; 205/122
(58) Field of Search ..... 205/67, 69, 70, 205/122

(56) References Cited

U.S. PATENT DOCUMENTS

| | | | |
|---|---|---|---|
| 2,101,304 | 12/1937 | Wright | 120/50 |
| 2,158,615 | 5/1939 | Wright | 120/50 |
| 2,187,528 | 1/1940 | Wing | 120/50 |
| 2,223,541 | 12/1940 | Baker | 120/50 |
| 2,266,706 | 12/1941 | Fox et al. | 128/173 |
| 2,283,333 | 5/1942 | Martin | 120/50 |
| 2,292,381 | 8/1942 | Klagges | 120/50 |
| 2,360,297 | 10/1944 | Wing | 120/52 |
| 2,375,770 | 5/1945 | Dahlberg | 120/52 |
| 2,404,063 | 7/1946 | Healy | 120/51 |

(List continued on next page.)

FOREIGN PATENT DOCUMENTS

| | | |
|---|---|---|
| 477 885 | 10/1969 | (CH) . |
| 555 681 | 9/1974 | (CH) . |
| 0 049 636 A1 | 4/1982 | (EP) . |
| 0 103 161 A2 | 3/1984 | (EP) . |
| 0 134 847 A1 | 3/1985 | (EP) . |
| 0 178 925 | 4/1986 | (EP) . |
| 0 542 723 A2 | 5/1993 | (EP) . |
| 0 476 991 B1 | 3/1995 | (EP) . |
| 2 692 569 A1 | 6/1992 | (FR) . |
| 973458 | 10/1964 | (GB) . |

(List continued on next page.)

OTHER PUBLICATIONS

Berglund, R.N., et al. Generation of Monodisperse Aerosol Standards. Environ. Sci. Technology 7:2:147 (1973) Feb.

Allen, T. Particle Size Measurement. Chapman and Hall pp. 167–169 (1981). No Month Available.

Ueha, S., et al. Mechanism of Ultrasonic Atomization Using a Multi–Pinhole Plate. J. Acoust. Soc. Jpn. (E) 6,1:21 (1985). Month Not Available.

Maehara, N., et al. Influence of the Vibrating System of a Multipinhole–plate Ultrasonic Nebulizer on Its Performance. Review of Scientific Instruments, 57 (11), Nov. 1986, pp. 2870–2876.

Maehara, N., et al. Optimum Design Procedure for Multi–Pinhole–plate Ultrasonic Atomizer. Japanese Journal of Applied Physics, 26:215 (1987). Month Not Available.

Ashgriz, N., et al. Development of a Controlled Spray Generator. Rev. Sci. Instrum. 58(7):291 (1987). Jul.

(List continued on next page.)

*Primary Examiner*—Kathryn Gorgos
*Assistant Examiner*—Erica Smith-Hicks
(74) *Attorney, Agent, or Firm*—Townsend and Townsend and Crew LLP

(57) ABSTRACT

A method for forming an aperture plate comprises providing a mandrel that is constructed of a mandrel body having a conductive surface and a plurality of non-conductive islands disposed on the conductive surface. The mandrel is placed within a solution containing a material that is to be deposited onto the mandrel. Electrical current is applied to the mandrel to form an aperture plate on the mandrel, with the apertures having an exit angle that is in the range from about 30° to about 60°.

21 Claims, 12 Drawing Sheets

U.S. PATENT DOCUMENTS

| | | | |
|---|---|---|---|
| 2,430,023 | 11/1947 | Longmaid | 120/52 |
| 2,474,996 | 7/1949 | Wallis | 120/52 |
| 2,512,004 | 6/1950 | Wing | 120/52 |
| 2,521,657 | 9/1950 | Severy | 120/50 |
| 2,681,041 | 6/1954 | Zodtner et al. | 120/50 |
| 2,779,623 | 1/1957 | Eisenkraft | 299/1 |
| 2,935,970 | 5/1960 | Morse et al. | 120/52 |
| 3,411,854 | 11/1968 | Rosler et al. | 401/227 |
| 3,558,052 | 1/1971 | Dunn | 293/3 |
| 3,738,574 | 6/1973 | Guntersdorfer et al. | 239/102 |
| 3,790,079 | 2/1974 | Berglund et al. | 239/3 |
| 3,804,329 | 4/1974 | Martner | 239/4 |
| 3,812,854 | 5/1974 | Michaels et al. | 128/194 |
| 3,950,760 | 4/1976 | Ilse-dore Stromberger et al. | 346/140 |
| 3,958,249 | 5/1976 | DeMaine et al. | 346/1 |
| 3,983,740 | 10/1976 | Danel | 73/12 |
| 4,005,435 | 1/1977 | Lundquist et al. | 346/1 |
| 4,119,096 | 10/1978 | Drews | 128/194 |
| 4,159,803 | 7/1979 | Cameto et al. | 239/102 |
| 4,240,081 | 12/1980 | Devitt | 346/75 |
| 4,261,512 | 4/1981 | Zierenberg | 239/102 |
| 4,268,460 | 5/1981 | Boiarski et al. | 261/1 |
| 4,294,407 | 10/1981 | Reichl et al. | 239/102 |
| 4,300,546 | 11/1981 | Kruber | 128/200 |
| 4,301,093 | 11/1981 | Eck | 261/1 |
| 4,334,531 | 6/1982 | Reichl et al. | 128/200.14 |
| 4,336,544 | 6/1982 | Donald et al. | 346/1.1 |
| 4,338,576 | 7/1982 | Takahashi et al. | 331/67 |
| 4,368,476 | 1/1983 | Uehara et al. | 346/140 R |
| 4,389,071 | 6/1983 | Johnson, Jr. et al. | 299/14 |
| 4,408,719 | 10/1983 | Last | 239/102 |
| 4,431,136 | 2/1984 | Janner et al. | 239/102 |
| 4,454,877 | 6/1984 | Miller et al. | 128/200.21 |
| 4,465,234 | 8/1984 | Maehara et al. | 239/102 |
| 4,474,251 | 10/1984 | Johnson, Jr. | 175/67 |
| 4,474,326 | 10/1984 | Takahashi | 239/102 |
| 4,475,113 | 10/1984 | Lee et al. | 346/1.1 |
| 4,479,609 | 10/1984 | Maeda et al. | 239/102 |
| 4,530,464 | 7/1985 | Yamamoto et al. | 239/102 |
| 4,533,082 | 8/1985 | Maehara et al. | 239/102 |
| 4,539,575 | 9/1985 | Nilsson | 346/140 R |
| 4,544,933 | 10/1985 | Heinzl | 346/140 R |
| 4,546,361 | 10/1985 | Brescia et al. | 346/140 R |
| 4,550,325 | 10/1985 | Viola | 346/140 R |
| 4,591,883 | 5/1986 | Isayama | 346/140 R |
| 4,593,291 | 6/1986 | Howkins | 346/1.1 |
| 4,605,167 | 8/1986 | Maehara | 239/102 |
| 4,620,201 | 10/1986 | Heinzl et al. | 346/140 R |
| 4,628,890 | 12/1986 | Freeman | 123/593 |
| 4,632,311 | 12/1986 | Nakane et al. | 239/101 |
| 4,659,014 | 4/1987 | Soth et al. | 239/102.2 |
| 4,681,264 | 7/1987 | Johnson, Jr. | 239/589.1 |
| 4,702,418 | 10/1987 | Carter et al. | 239/101 |
| 4,722,906 | 2/1988 | Guire | 436/501 |
| 4,753,579 | 6/1988 | Murphy | 417/322 |
| 4,790,479 | 12/1988 | Matsumoto et al. | 239/102.2 |
| 4,793,339 | 12/1988 | Matsumoto et al. | 128/200.16 |
| 4,796,807 | 1/1989 | Bendig et al. | 239/102.2 |
| 4,799,622 | 1/1989 | Ishikawa et al. | 239/102.2 |
| 4,826,759 | 5/1989 | Guire et al. | 435/4 |
| 4,828,886 | 5/1989 | Hieber | 427/422 |
| 4,850,534 | 7/1989 | Takahashi et al. | 239/102.2 |
| 4,865,006 | 9/1989 | Nogi et al. | 123/590 |
| 4,877,989 | 10/1989 | Drews et al. | 310/323 |
| 4,888,516 | 12/1989 | Daeges et al. | 310/323 |
| 4,973,493 | 11/1990 | Guire | 427/2 |
| 4,976,259 | 12/1990 | Higson et al. | 128/200.18 |
| 4,979,959 | 12/1990 | Guire | 623/66 |
| 5,002,582 | 3/1991 | Guire et al. | 623/66 |
| 5,021,701 | 6/1991 | Takahashi et al. | 310/345 |
| 5,063,396 | 11/1991 | Shiokawa et al. | 346/140 R |
| 5,063,922 | 11/1991 | Hakkinen | 128/200.16 |
| 5,073,484 | 12/1991 | Swanson et al. | 435/7.92 |
| 5,076,266 | 12/1991 | Babaev | 128/200.16 |
| 5,115,803 | 5/1992 | Sioutas | 128/200.23 |
| 5,139,016 | 8/1992 | Waser | 128/200.16 |
| 5,152,456 | 10/1992 | Ross et al. | 239/102.2 |
| 5,164,740 | 11/1992 | Irvi | 346/1.1 |
| 5,170,782 | 12/1992 | Kocinski | 128/200.16 |
| 5,180,482 * | 1/1993 | Abys et al. | 205/224 |
| 5,186,166 | 2/1993 | Riggs et al. | 128/203.15 |
| 5,198,157 | 3/1993 | Bechet | 264/9 |
| 5,217,492 | 6/1993 | Guire et al. | 623/11 |
| 5,258,041 | 11/1993 | Guire et al. | 623/66 |
| 5,261,601 | 11/1993 | Ross et al. | 239/102.2 |
| 5,263,992 | 11/1993 | Guire | 623/66 |
| 5,297,734 | 3/1994 | Toda | 239/102.2 |
| 5,299,739 | 4/1994 | Takahashi et al. | 239/102.2 |
| 5,312,281 | 5/1994 | Takashashi et al. | 446/25 |
| 5,347,998 | 9/1994 | Hodson et al. | 128/200.23 |
| 5,414,075 | 5/1995 | Swan et al. | 568/333 |
| 5,415,161 | 5/1995 | Ryder | 128/200.23 |
| 5,458,135 | 10/1995 | Patton et al. | 128/200.14 |
| 5,477,992 | 12/1995 | Jinks et al. | 222/402.2 |
| 5,487,378 | 1/1996 | Robertson et al. | 128/200.16 |
| 5,512,329 | 4/1996 | Guire | 427/508 |
| 5,512,474 | 4/1996 | Clapper et al. | 435/240.243 |
| 5,515,841 | 5/1996 | Robertson et al. | 128/200.16 |
| 5,515,842 | 5/1996 | Lamseyev et al. | 128/200.18 |
| 5,518,179 | 5/1996 | Humbertsone et al. | 239/102.2 |
| 5,533,497 | 7/1996 | Ryder | 128/200.21 |
| 5,560,837 * | 10/1996 | Trueba | 216/27 |
| 5,563,056 | 10/1996 | Swan et al. | 435/180 |
| 5,579,757 | 12/1996 | McMahon et al. | 128/200.21 |
| 5,586,550 | 12/1996 | Ivri et al. | 128/200.16 |
| 5,637,460 | 6/1997 | Swan et al. | 435/6 |
| 5,654,007 | 8/1997 | Johnson et al. | 424/489 |
| 5,654,182 | 8/1997 | Guire et al. | 435/7.92 |
| 5,654,460 | 8/1997 | Rong | 556/472 |
| 5,692,644 | 12/1997 | Gueyet | 222/80 |
| 5,707,818 | 1/1998 | Chudzik et al. | 435/7.93 |
| 5,714,360 | 2/1998 | Swan et al. | 435/174 |
| 5,714,551 | 2/1998 | Bezwada et al. | 525/411 |
| 5,744,515 | 4/1998 | Clapper | 523/113 |
| 5,758,637 | 6/1998 | Irvi et al. | 128/200.16 |

FOREIGN PATENT DOCUMENTS

| | | |
|---|---|---|
| 1454597 | 11/1976 | (GB) . |
| 2 073 616 A | 10/1981 | (GB) . |
| 2 101 500 | 1/1983 | (GB) . |
| 2 177 623 A | 1/1987 | (GB) . |
| 2 240 494 A | 8/1991 | (GB) . |
| 2 272 389 A | 5/1994 | (GB) . |
| 2 279 571 A | 1/1995 | (GB) . |
| 57-23852 | 2/1982 | (JP) . |
| 57-105608 | 7/1982 | (JP) . |
| 58-61857 | 4/1983 | (JP) . |
| 58-139757 | 8/1983 | (JP) . |
| 60-4714 | 1/1985 | (JP) . |
| 61-8357 | 1/1986 | (JP) . |
| 61-215059 | 9/1986 | (JP) . |
| 2-135169 | 5/1990 | (JP) . |
| 2-189161 | 7/1990 | (JP) . |
| WO 92/07600 | 5/1992 | (WO) . |
| WO 92/11050 | 7/1992 | (WO) . |
| WO 93/01404 | 1/1993 | (WO) . |
| WO 96/09229 | 3/1996 | (WO) . |

OTHER PUBLICATIONS

Siemens AG, 1989, "Ink–Jet Printing: The Present State of the Art," by Wolfgang R. Wehl. Month Unavailable.

Tsi Incorporated product catalog. Vibrating Orifice Aerosol generator (1989). Month Unavaible.

Gaiser Tool Company catalog, pp. 26, 29–30 (19_). Month/Year Not Available.

D.C. Cipolla et al., "Assessmant of Aerosol Delivery systems for Recomvinant Human Deoxyribonuclease," *S.T.P. Pharma Sciences* 4 (1) 50–62, 1994 Month Not Available.

D.C. Cipolla et al., "Characterization of Aerosols of Human Recombinant Deoxyribonuclease I (rhDNase) Generated by Jet Nebulizerg," *Pharmaceutical Research* II (4) 491–498, 1994. Month Not Available.

I. Gonda, "Therapeutic Aerosols," *Pharmaceutics, The Sci. of Dosage Form Design*, M.E. Aulton, 341–358, 1988 Month Not Available.

Anthony J. Hickey, "Pharmaceutical Inhalation Aerosol Technology," *Drugs And The Pharmaceutical Sciences*, (54) 172–173.

J.A. Abys et al., "Annealing Behavior of Palladium–Nickel All Electrodeposits," pp. 1–7. Month/Yr. Not Available.

"Palla Tech Pd an Pd Alloy Processes—Procedure for the Analysis of Additive IVS in Palla Tech Plating Solutions by HPLC," *Technical Bulletin*, Electroplating Chemicals & Services, 029–A, Lucent Technologies, , pp. 1–5, 1996 Oct.

* cited by examiner

METHOD FOR THE CONSTRUCTION OF AN APERTURE PLATE FOR DISPENSING LIQUID DROPLETS

BACKGROUND OF THE INVENTION

This invention relates generally to the field of liquid dispensing, and in particular to the aerosolizing of fine liquid droplets. More specifically, the invention relates to the formation and use of aperture plates employed to produce such fine liquid droplets.

A great need exists for the production of fine liquid droplets. For example, fine liquid droplets are used in for drug delivery, insecticide delivery, deodorization, paint applications, fuel injectors, and the like. In many applications, it may be desirable to produce liquid droplets that have an average size down to about 0.5 $\mu$l. For example, in many medical applications, such a size is needed to insure that the inhaled drug reaches the deep lung.

U.S. Pat. Nos. 5,164,740; 5,586,550; and 5,758,637, the complete disclosures of which are herein incorporated by reference, describe exemplary devices for producing fine liquid droplets. These patents describe the use of aperture plates having tapered apertures to which a liquid is supplied. The aperture plates are then vibrated so that liquid entering the larger opening of each aperture is dispensed through the small opening of each aperture to produce the liquid droplets. Such devices have proven to be tremendously successful in producing liquid droplets.

Another technique for aerosolizing liquids is described in U.S. Pat. No. 5,261,601 and utilizes a perforate membrane disposed over a chamber. The perforate membrane comprises an electroformed metal sheet using a "photographic process" that produces apertures with a cylindrical exit opening.

The invention provides for the construction and use of other aperture plates that are effective in producing fine liquid droplets at a relatively fast rate. As such, it is anticipated that the invention will find even greater use in many applications requiring the use of fine liquid droplets.

SUMMARY OF THE INVENTION

The invention provides exemplary aperture plates and methods for their construction and use in producing fine, liquid droplets at a relatively fast rate. In one embodiment, a method is provided for forming an aperture plate. The method utilizes a mandrel that comprises a mandrel body having a conductive surface and a plurality of nonconductive islands disposed on the conductive surface such that the islands extend above the conductive surface. The mandrel is placed within a solution containing a material that is to be deposited onto the mandrel. Electrical current is then applied to the mandrel to form an aperture plate on the mandrel, with the apertures having an exit angle that is in the range from about 30° to about 60°, more preferably from about 41° to about 49°, and still more preferably about 45°. Construction of the aperture plate to have such an exit angle is particularly advantageous in that it maximizes the rate of droplet production through the apertures.

In one particular aspect, the islands have a geometry that approaches a generally conical shape or a dome shape having a circular base, with the base being seated on the mandrel body. Conveniently, the islands may have a base diameter in the range from about 20 microns to about 200 microns, and a height in the range from about 4 microns to about 20 microns.

In another particular aspect, the islands are formed from a photoresistent material using a photolithography process. Conveniently, the islands may be treated following the photolithography process to alter the shape of the islands. In another aspect, the aperture plate is removed from the mandrel, and is formed into a dome shape. In still another aspect, the material in the solution that forms the aperture plate may be a material such as a palladium nickel alloy, palladium cobalt, or other palladium or gold alloys.

The invention further provides an exemplary aperture plate that comprises a plate body having a top surface, a bottom surface, and a plurality of apertures that taper in a direction from the top surface to the bottom surface. Further, the apertures have an exit angle that is in the range from about 30° to about 60°, more preferably about 41° to about 49°, and more preferably at about 45°. The apertures also have a diameter that is in the range from about 1 micron to about 10 microns at the narrowest portion of the taper. Such an aperture plate is advantageous in that it may produce liquid droplets having a size that are in the range from about 2 $\mu$m to about 10 $\mu$m, at a rate in the range from about 4 $\mu$L to about 30 $\mu$L per 1000 apertures per second. In this way, the aperture plate may be employed to aerosolize a sufficient amount of a liquid medicament so that a capture chamber that may otherwise be employed to capture the aerosolized medicament will not be needed.

The aperture plate may be constructed of a high strength and corrosion resistant material. As one example, the plate body may be constructed from a palladium nickel alloy. Such an alloy is corrosion resistant to many corrosive materials particularly solutions for treating respiratory diseases by inhalation therapy, such as an albuterol sulfate and ipratroprium solution, which is used in many medical applications. Further, the palladium nickel alloy has a low modulus of elasticity and therefore a lower stress for a given oscillation amplitude. Other materials that may be used to construct the plate body include gold, gold alloys, and the like.

In another aspect, the plate body has a portion that is dome shaped in geometry. In one particular aspect, the plate body has a thickness in the range from about 20 microns to about 70 microns.

In another embodiment, the invention provides a mandrel for forming an aperture plate. The mandrel comprises a mandrel body or plate having a conductive, generally flat top surface and a plurality of nonconductive islands disposed on the conductive surface. The islands extend above the conductive surface and have a geometry approaching a generally conical or dome shape. Such a mandrel is particularly useful in an electroforming process that may be employed to form an aperture plate on the mandrel body. The shaped nonconductive islands when used in such a process assist in producing apertures that have an exit angle in the range from about 30° to about 60°, more typically in the range from about 41° to about 49°, and still more typically at about 45°.

In one aspect, the islands have a base diameter in the range from about 20 microns to about 200 microns, and a height in the range from about 4 microns to about 20 microns. In another aspect, the islands may have an average slope in the range from about 15° to about 30° relative to the conductive surface. Conveniently, the islands may be formed from a photoresist material using a photolithography process. The islands may be treated following the photolithography process to further shape the islands.

In still another embodiment, the invention provides a method for producing a mandrel that may be employed to form an aperture plate. According to the method, an electroforming mandrel body is provided. A photoresist film is applied to the mandrel body, and a mask having a pattern of circular regions is placed over the photoresist film. The photoresist film is then developed to form an arrangement of nonconductive islands that correspond to the location of the holes in the pattern. Following this step, the mandrel body is heated to permit the islands to melt and flow into a desired shape. For example, the islands may be heated until they are generally conical or dome shaped in geometry and have a slope relative to the surface of the mandrel body. Optionally, the steps of applying the photoresist film, placing a mask having a smaller pattern of circular regions over the photoresist film, developing the photoresist film and heating the mandrel body may be repeated to form layers of a photoresist material and thereby further modify the shape of the nonconductive islands.

In one aspect, the photoresist film has a thickness in the range from about 4 microns to about 15 microns. In another aspect, the mandrel body is heated to a temperature in the range from about 50° C. to about 250° C. for about 30 minutes. Typically, the mandrel body will be heated to this temperature at a rate that is less than about 3° C. per minute.

The invention still further provides a method for aerosolizing a liquid. According to the method, an aperture plate is provided that comprises a plate body having a top surface, a bottom surface, and a plurality of apertures that taper in a direction from the top surface to the bottom surface. The apertures have an exit angle that is in the range from about 30° to about 60° preferably in the range from about 41° to about 49°, more preferably at about 45°. The apertures also have a diameter that is in the range from about 1 micron to about 10 microns at the narrowest portion of the taper. A liquid is supplied to the bottom surface of the aperture plate, and the aperture plate is vibrated to eject liquid droplets from the top surface.

Typically, the droplets have a size in the range from about 2 $\mu$m to about 10 $\mu$m. Conveniently, the aperture plate may be provided with at least about 1,000 apertures so that a volume of liquid in the range from about 4 $\mu$L to about 30 $\mu$L may be produced within a time of less than about one second. In this way, a sufficient dosage may be aerosolized so that a patient may inhale the aerosolized medicament without the need for a capture chamber to capture and hold the prescribed amount of medicament.

In one particular aspect, the liquid that is supplied to the bottom surface is held to the bottom surface by surface tension forces until the liquid droplets are ejected from the top surface. In another aspect, the aperture plate is vibrated at a frequency in the range from about 80 KHz to about 200 KHz.

DESCRIPTION OF THE SPECIFIC EMBODIMENTS

Figure 1:
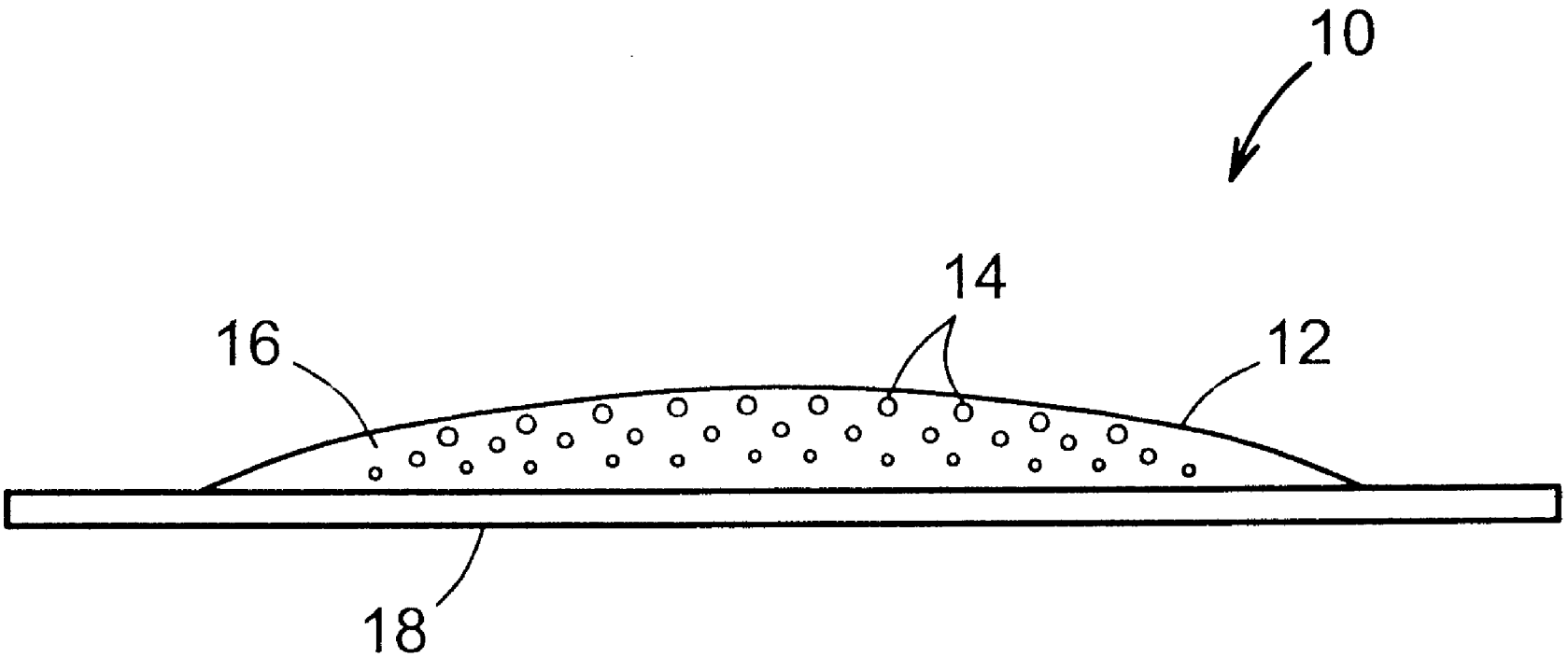
FIG. 1 is a side view of one embodiment of an aperture plate according to the invention.

The invention provides exemplary aperture plates and methods for their construction and use. The aperture plates of the invention are constructed of a relatively thin plate that may be formed into a desired shape and includes a plurality of apertures that are employed to produce fine liquid droplets when the aperture plate is vibrated. Techniques for vibrating such aperture plates are described generally in U.S. Pat. Nos. 5,164,740; 5,586,550; and 5,758,637, previously incorporated herein by reference. The aperture plates are constructed to permit the production of relatively small liquid droplets at a relatively fast rate. For example, the aperture plates of the invention may be employed to produce liquid droplets having a size in the range from about 2 microns to about 10 microns, and more typically between about 2 microns to about 5 microns. In some cases, the aperture plates may be employed to produce a spray that is useful in pulmonary drug delivery procedures. As such, the sprays produced by the aperture plates may have a respirable fraction that is greater than about 70%, preferably more than about 80%, and most preferably more than about 90% as described in U.S. Pat. No. 5,758,637, previously incorporated by reference.

In some embodiments, such fine liquid droplets may be produced at a rate in the range from about 4 microliters per second to about 30 microliters per second per 1000 apertures. In this way, aperture plates may be constructed to have multiple apertures that are sufficient to produce aerosolized volumes that are in the range from about 4 microliters to about 30 microliters, within a time that is less than about one second. Such a rate of production is particularly useful for pulmonary drug delivery applications where a desired dosage is aerosolized at a rate sufficient to permit the aerosolized medicament to be directly inhaled. In this way, a capture chamber is not needed to capture the liquid droplets until the specified dosage has been produced. In this manner, the aperture plates may be included within aerosolizers, nebulizers, or inhalers that do not utilize elaborate capture chambers.

As just described, the invention may be employed to deliver a wide variety of drugs to the respiratory system. For example, the invention may be utilized to deliver drugs having potent therapeutic agents, such as hormones, peptides, and other drugs requiring precise dosing including drugs for local treatment of the respiratory system.

Examples of liquid drugs that may be aerosolized include drugs in solution form, e.g., aqueous solutions, ethanol solutions, aqueous/ethanol mixture solutions, and the like, in colloidal suspension form, and the like. The invention may also find use in aerosolizing a variety of other types of liquids, such as insulin.

In one aspect, the aperture plates may be constructed of materials having a relatively high strength and that are resistant to corrosion. One particular material that provides such characteristics is a palladium nickel alloy. One particularly useful palladium nickel alloy comprises about 80% palladium and about 20% nickel. Other useful palladium nickel alloys are described generally in J. A. Abys, et al., "Annealing Behavior of Palladium-Nickel Alloy Electrodeposits," *Plating and Surface Finishing*, August 1996, "PallaTech® Procedure for the Analysis of Additive IVS in PallaTech® Plating Solutions by HPLC" *Technical Bulletin*, Lucent Technologies, Oct. 1, 1996, and in U.S. Pat. No. 5,180,482, the complete disclosures of which are herein incorporated by reference.

Aperture plates constructed of such a palladium nickel alloy have significantly better corrosion resistance as compared to nickel aperture plates. As one example, a nickel aperture plate will typically corrode at a rate of about 1 micron per hour when an albuterol sulfate solution (PH 3.5) is flowing through the apertures. In contrast, the palladium nickel alloy of the invention does not experience any detectable corrosion after about 200 hours. Hence, the palladium nickel alloy aperture plates of the invention may be used with a variety of liquids without significantly corroding the aperture plate. Examples of liquids that may be used and which will not significantly corrode such an aperture plate include albuterol, chromatin, and other inhalation solutions that are normally delivered by jet nebulizers, and the like.

Another advantage of the palladium nickel alloy is that it has a low modulus of elasticity. As such, the stress for a given oscillation amplitude is lower as compared to a nickel aperture plate. As one example, the modulus of elasticity for such a palladium alloy is about $12\times10^6$ psi, whereas the modulus of elasticity for nickel is about $33\times10^6$ psi. Since the stress is proportional to the amount of elongation and the modulus of elasticity, by providing the aperture plate with a lower modulus of elasticity, the stress on the aperture plate is significantly reduced.

Alternative materials for constructing the aperture plates of the invention include pure palladium and gold, as well as those described in copending U.S. application Ser. No. 09/313,914, filed May 18, 1999, pending the complete disclosure of which is herein incorporated by reference.

To enhance the rate of droplet production while maintaining the droplets within a specified size range, the apertures may be constructed to have a certain shape. More specifically, the apertures are preferably tapered such that the aperture is narrower in cross section where the droplet exits the aperture. In one embodiment, the angle of the aperture at the exit opening (or the exit angle) is in the range from about 30° to about 60°, more preferably from about 41° to about 49°, and more preferably at about 45°. Such an exit angle provides for an increased flow rate while minimizing droplet size. In this way, the aperture plate may find particular use with inhalation drug delivery applications.

The apertures of the aperture plates will typically have an exit opening having a diameter in the range from about 1 micron to about 10 microns, to produce droplets that are about 2 microns to about 10 microns in size. In another aspect, the taper at the exit angle is preferably within the desired angle range for at least about the first 15 microns of the aperture plate. Beyond this point, the shape of the aperture is less critical. For example, the angle of taper may increase toward the opposite surface of the aperture plate.

Conveniently, the aperture plates of the invention may be formed in the shape of a dome as described generally in U.S. Pat. No. 5,758,637, previously incorporated by reference. Typically, the aperture plate will be vibrated at a frequency in the range from about 45 kHz to about 200 kHz when aerosolizing a liquid. Further, when aerosolizing a liquid, the liquid may be placed onto a rear surface of the aperture plate where the liquid adheres to the rear surface by surface tension forces. Upon vibration of the aperture plate, liquid droplets are ejected from the front surface as described generally in U.S. Pat. Nos. 5,164,740, 5,586,550 and 5,758,637, previously incorporated by reference.

The aperture plates of the invention may be constructed using an electrodeposition process where a metal is deposited from a solution onto a conductive mandrel by an electrolytic process. In one particular aspect, the aperture plates are formed using an electroforming process where the metal is electroplated onto an accurately made mandrel that has the inverse contour, dimensions, and surface finish desired on the finished aperture plate. When the desired thickness of deposited metal has been attained, the aperture plate is separated from the mandrel. Electroforming techniques are described generally in E. Paul DeGarmo, "Materials and Processes in Manufacturing" McMillan Publishing Co., Inc., New York, $5^{th}$ Edition, 1979, the complete disclosure of which is herein incorporated by reference.

The mandrels that may be utilized to produce the aperture plates of the invention may comprise a conductive surface having a plurality of spaced apart nonconductive islands. In this way, when the mandrel is placed into the solution and current is applied to the mandrel, the metal material in the solution is deposited onto the mandrel. Examples of metals which may be electrodeposited onto the mandrel to form the aperture plate have been described above.

One particular feature of the invention is the shape of the nonconductive islands on the aperture plate. These islands may be constructed with a certain shape to produce apertures that have exit angles in the ranges as described above. Examples of geometric configurations that may be employed include islands having a generally conical shape, a dome shape, a parabolic shape, and the like. The nonconductive islands may be defined in terms of an average angle or slope, i.e., the angle extending from the bottom of the island to the top of the island relative to the conductive surface, or using the ratio of the base and the height. The magnitude of this angle is one factor to be considered in forming the exit angle in the aperture plate. For instance, formation of the exit angle in the aperture plate may depend on the electroplating time, the solution used with the electroplating process, and the angle of taper of the nonconductive islands. These variables may be altered alone or in combination to achieve the desired exit angle in the aperture plate. Also, the size of the exit opening may also depend on the electroplating time.

As one specific example, the height and diameter of the nonconductive islands may be varied depending on the desired end dimensions of the apertures and/or on the process employed to create the aperture plates. For instance, in some cases the rear surface of the aperture plate may be formed above the islands. In other cases, the rear surface of the aperture plate may be formed adjacent to the conductive surface of the mandrel. In the latter case, the size of the exit opening may be defined by the cross-sectional dimension of the non-conductive islands at the ending thickness value of the aperture plate. For the former process, the nonconductive islands may have a height that is up to about 30 percent of the total thickness of the aperture plate.

To construct the nonconductive islands, a photolithography process may be employed. For example, a photoresist film may be applied to the mandrel body and a mask having a pattern of circular regions placed over the photoresist film. The photoresist film may then be developed to form an arrangement of nonconductive islands that correspond to the location of the holes in the pattern. The nonconductive islands may then be further treated to produce the desired shape. For example, the mandrel may be heated to allow the photoresist material to melt and flow into the desired shape. Optionally, this process may be repeated one or more additional times to build up layers of photoresist materials. During each additional step, the size of the holes in the pattern may be reduced to assist in producing the generally conical shape of the islands.

A variety of other techniques may be employed to place a pattern of nonconducted material onto the electroforming mandrel. Examples of techniques that may be employed to produce the desired pattern include exposure, silk screening, and the like. This pattern is then employed to control where plating of the material initiates and continues throughout the plating process. A variety of nonconductive materials may be employed to prevent plating on the conductive surface, such as a photoresist, plastic, and the like. As previously mentioned, once the nonconducting material is placed onto the mandrel, it may optionally be treated to obtain the desired profile. Examples of treatments that may be used include baking, curing, heat cycling, carving, cutting, molding or the like. Such processes may be employed to produce a curved or angled surface on the nonconducting pattern which may then be employed to modify the angle of the exit opening in the aperture plate.

Referring now to FIG. 1, one embodiment of an aperture plate 10 will be described. Aperture plate 10 comprises a plate body 12 into which are formed a plurality of tapered apertures 14. Plate body 12 may be constructed of a metal, such as a palladium nickel alloy or other metal as previously described. Conveniently, plate body 12 may be configured to have a dome shape as described generally in U.S. Pat. No. 5,758,637, previously incorporated by reference. Plate body 12 includes a top or front surface 16 and a bottom or rear surface 18. In operation, liquid is supplied to rear surface 18 and liquid droplets are ejected from front surface 16.

Figure 2:
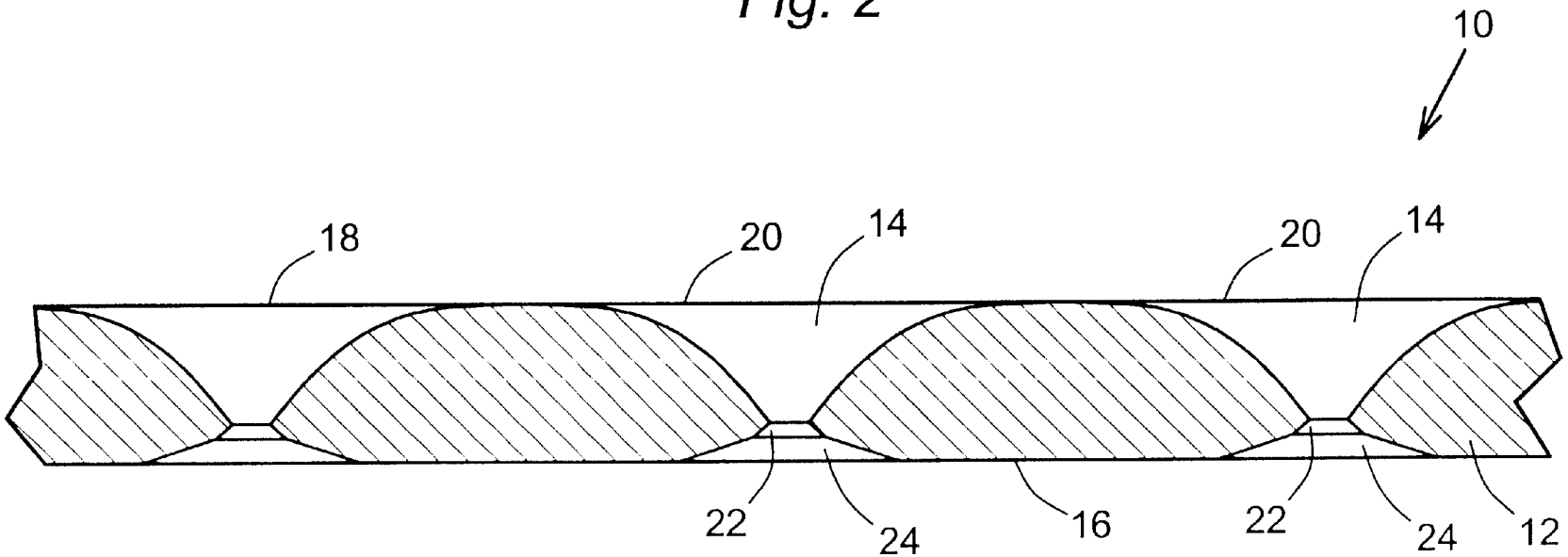
FIG. 2 is a cross-sectional side view of a portion of the aperture plate of FIG. 1.

Referring now to FIG. 2, the configuration of apertures 14 will be described in greater detail. Apertures 14 are configured to taper from rear surface 18 to front surface 16. Each aperture 14 has an entrance opening 20 and an exit opening 22. With this configuration, liquid supplied to rear surface 18 proceeds through entrance opening 20 and exits through exit opening 22. As shown, plate body 12 further includes a flared portion 24 adjacent exit opening 22. As described in greater detail hereinafter, flared portion 24 is created from the manufacturing process employed to produce aperture plate 10.

Figure 3:
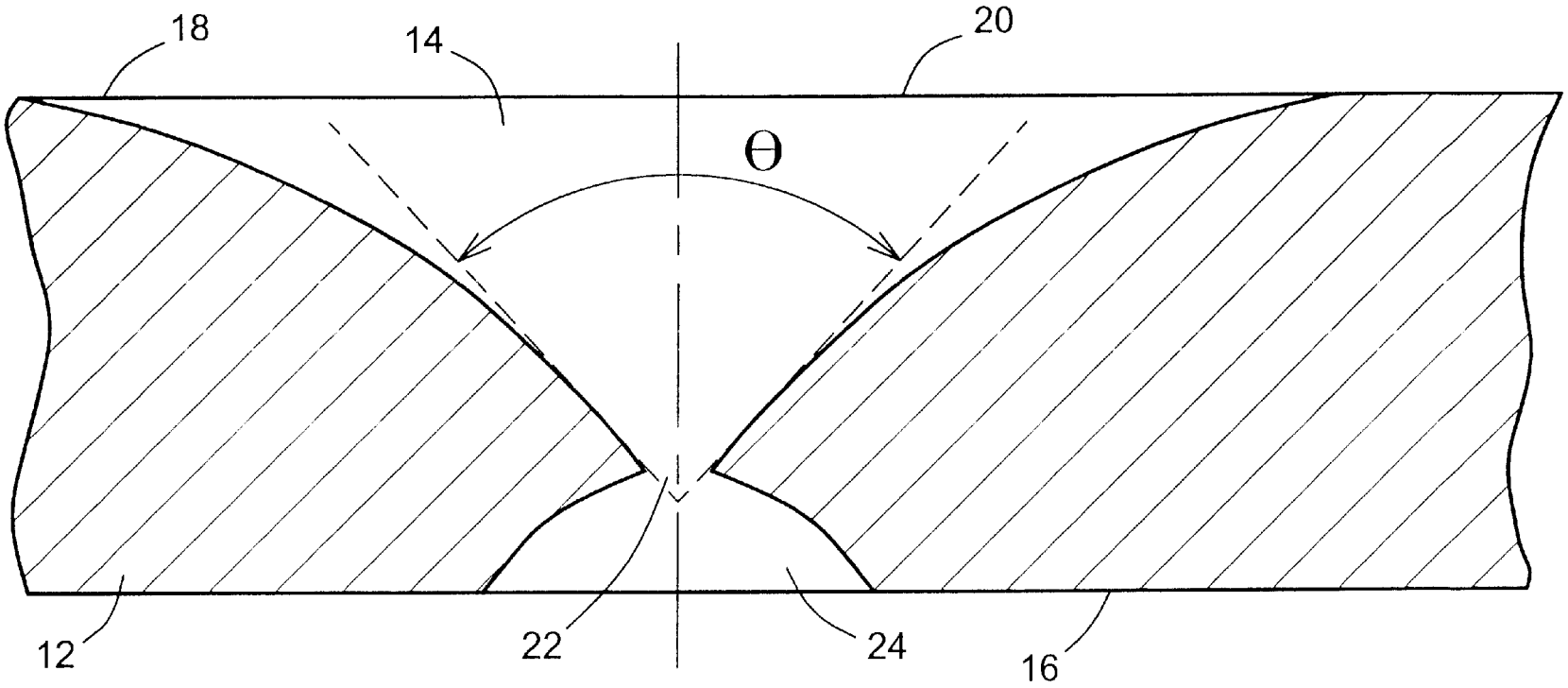
FIG. 3 is a more detailed view of one of the apertures of the aperture plate of FIG. 2.

As best shown in FIG. 3, the angle of taper of apertures 14 as they approach exit openings 22 may be defined by an exit angle θ. The exit angle is selected to maximize the ejection of liquid droplets through exit opening 20 while maintaining the droplets within a desired size range. Exit angle θ may be constructed to be in the range from about 30° to about 60°, more preferably from about 41° to about 49°, and most preferably around 45°. Also, exit opening 22 may have a diameter in the range from about 1 micron to about 10 microns. Further, the exit angle θ preferably extends over a vertical distance of at least about 15 microns, i.e., exit angel θ is within the above recited ranges at any point within this vertical distance. As shown, beyond this vertical distance, apertures 14 may flare outward beyond the range of the exit angle θ.

In operation, liquid is applied to rear surface 18. Upon vibration of aperture plate 10, liquid droplets are ejected through exit opening 22. In this manner, the liquid droplets will be propelled from front surface 16. Although exit opening 22 is shown inset from front surface 16, it will be appreciated that other types of manufacturing processes may be employed to place exit opening 22 directly at front surface 16.

Figure 4:
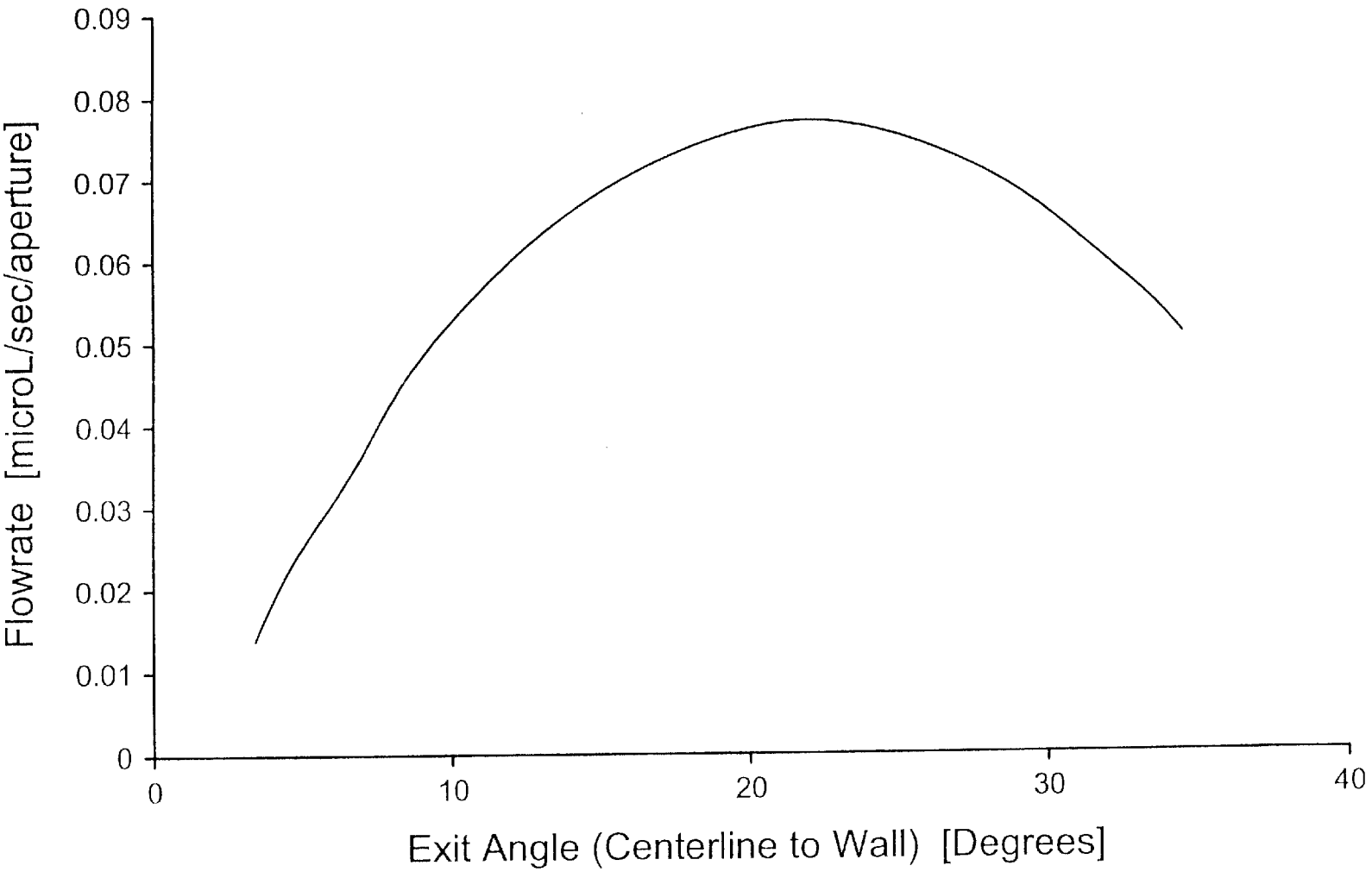
FIG. 4 is a graph illustrating the flow rate of liquid through an aperture as the exit angle of the aperture is varied.

Shown in FIG. 4 is a graph containing aerosolization simulation data when vibrating an aperture plate similar to aperture plate 10 of FIG. 1. In the graph of FIG. 4, the aperture plate was vibrated at about 180 kHz when a volume of water was applied to the rear surface. Each aperture had a exit diameter of 5 microns. In the simulation, the exit angle was varied from about 10° to about 70° (noting that the exit angle in FIG. 4 is from the center line to the wall of the aperture). As shown, the maximum flow rate per aperture occurred at about 45°. Relatively high flow rates were also achieved in the range from about 41° to about 49°. Exit angles in the range from about 30° to about 60° also produced high flow rates. Hence, in this example, a single aperture is capable of ejecting about 0.08 microliters of water per second when ejecting water. For many medical solutions, an aperture plate containing about 1000 apertures that each have an exit angle of about 45° may be used to produce a dosage in the range from about 30 microliters to about 50 microliters within about one second. Because of such a rapid rate of production, the aerosolized medicament may be inhaled by the patient within a few inhalation maneuvers without first being captured within a capture chamber.

It will be appreciated that the invention is not intended to be limited by this specific example. Further, the rate of production of liquid droplets may be varied by varying the exit angle, the exit diameter and the type of liquid being aerosolized. Hence, depending on the particular application (including the required droplet size), these variables may be altered to produce the desired aerosol at the desired rate.

Figure 5:
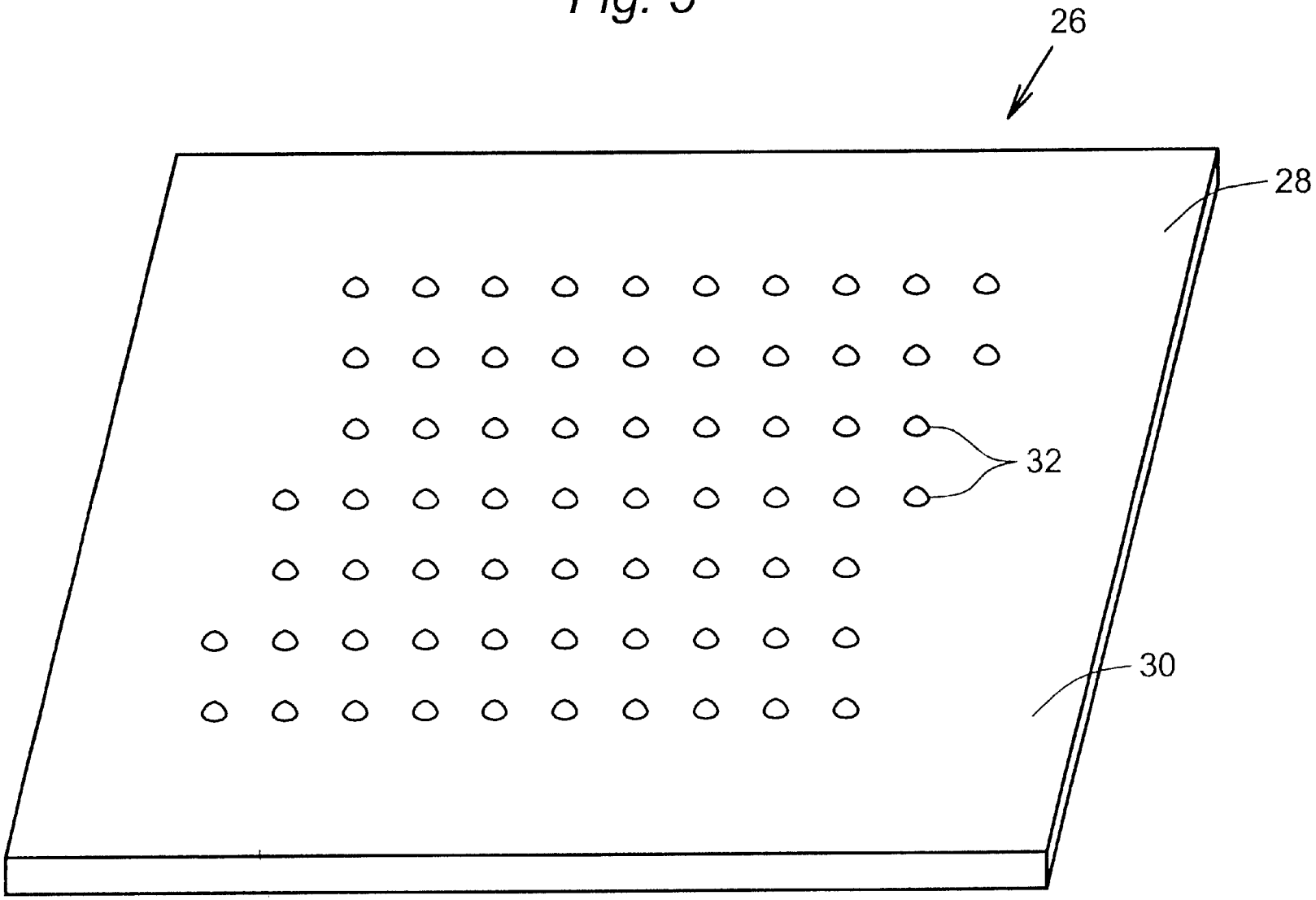
FIG. 5 is a top perspective view of one embodiment of a mandrel having nonconductive islands to produce an aperture plate in an electroforming process according to the invention.

Referring now to FIG. 5, one embodiment of an electroforming mandrel 26 that may be employed to construct aperture plate 10 of FIG. 1 will be described. Mandrel 26 comprises a mandrel body 28 having a conductive surface 30. Conveniently, mandrel body 28 may be constructed of a metal, such as stainless steel. As shown, conductive surface 30 is flat in geometry. However, in some cases it will be appreciated that conductive surface 30 may be shaped depending on the desired shape of the resulting aperture plate.

Disposed on conductive surface 30 are a plurality of nonconductive islands 32. Islands 32 are configured to extend above conductive surface 30 so that they may be employed in electroforming apertures within the aperture plate as described in greater detail hereinafter. Islands 32 may be spaced apart by a distance corresponding to the desired spacing of the resulting apertures in the aperture plate. Similarly, the number of islands 32 may be varied depending on the particular need.

Figure 6:
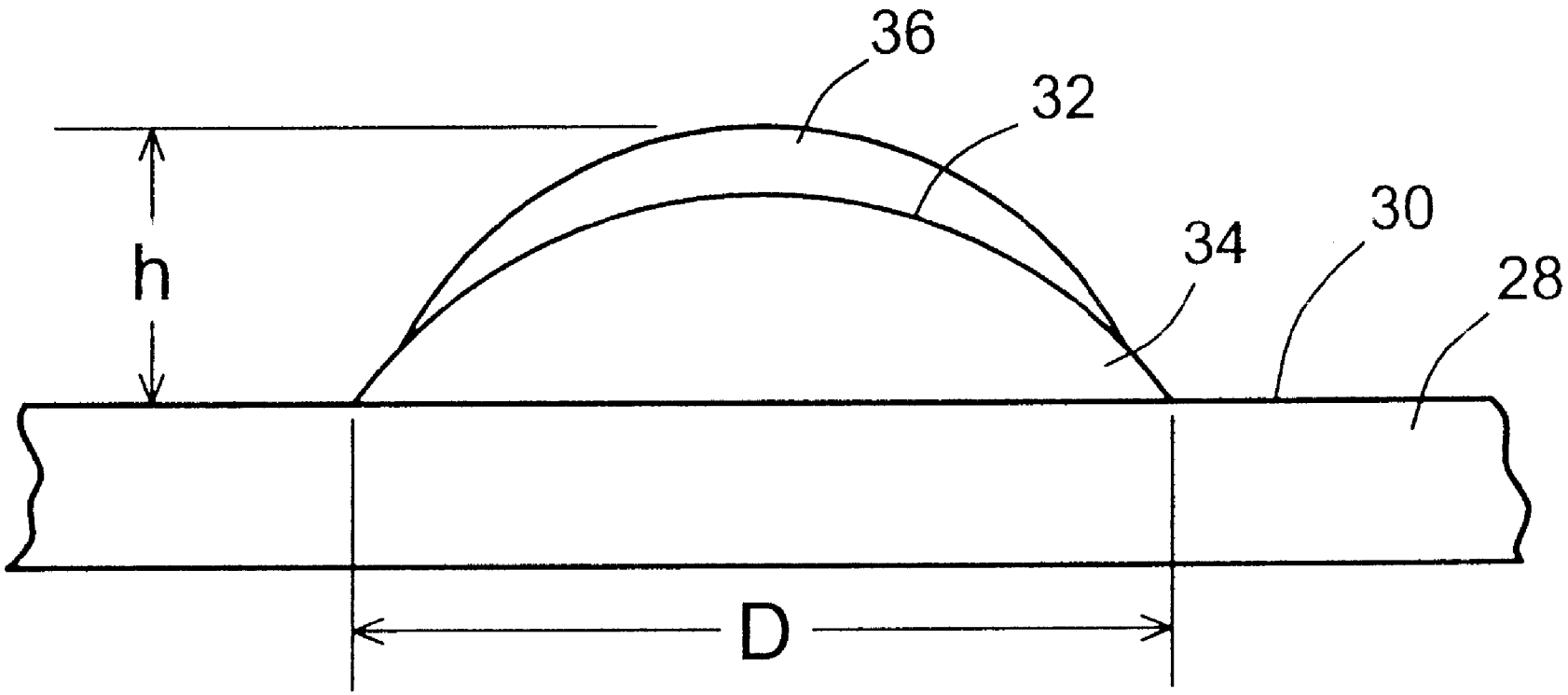
FIG. 6 is a side view of a portion of the mandrel of FIG. 5 showing one of the nonconductive islands in greater detail.

Referring now to FIG. 6, construction of islands 32 will be described in greater detail. As shown, island 32 is generally conical or dome shaped in geometry. Conveniently, island 32 may be defined in terms of a height h and a diameter D. As such, each island 32 may be said to include an average angle of incline or slope that is defined by the inverse tangent of ½ (D)/h. The average angle of incline may be varied to produce the desired exit angle in the aperture plate as previously described.

As shown, island 32 is constructed of a bottom layer 34 and a top layer 36. As described in greater detail hereinafter, use of such layers assists in obtaining the desired conical or domed shape. However, it will be appreciated that islands 32 may in some cases be constructed from only a single layer or multiple layers.

Figure 7:
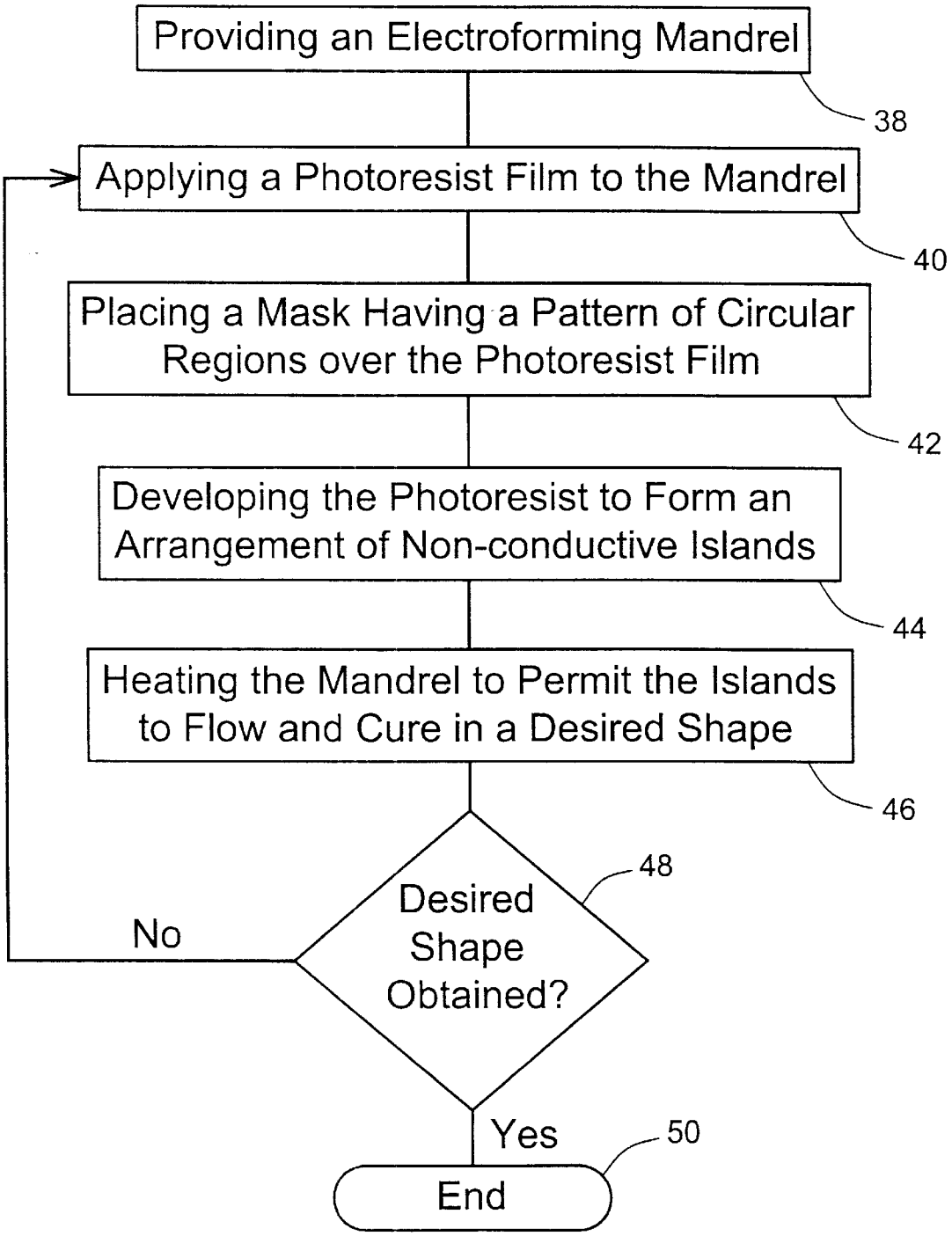
FIG. 7 is a flow chart illustrating one method for producing an electroforming mandrel according to the invention.

Referring now to FIG. 7, one method for forming nonconductive islands 32 on mandrel body 28 will be described. As shown in step 38, the process begins by providing an electroforming mandrel. As shown in step 40, a photoresist film is then applied to the mandrel. As one example, such a photoresist film may comprise a thick film photoresist having a thickness in the range from about 7 to about 9 microns. Such a thick film photoresist may comprise a Hoechst Celanese AZ P4620 positive photoresist. Conveniently, such a resist may be pre-baked in a convection oven in air or other environment for about 30 minutes at about 100° C. As shown in step 42, a mask having a pattern of circular regions is placed over the photoresist film. As shown in step 44, the photoresist film is then developed to form an arrangement of nonconductive islands. Conveniently, the resist may be developed in a basic developer, such as a Hoechst Celanese AZ 400 K developer. Although described in the context of a positive photoresist, it will be appreciated that a negative photoresist may also be used as is known in the art.

As shown in step 46, the islands are then treated to form the desired shape by heating the mandrel to permit the islands to flow and cure in the desired shape. The conditions of the heating cycle of step 46 may be controlled to determine the extent of flow (or doming) and the extent of curing that takes place, thereby affecting the durability and permanence of the pattern. In one aspect, the mandrel is slowly heated to an elevated temperature to obtain the desired amount of flow and curing. For example, the mandrel and the resist may be heated at a rate of about 2° C. per minute from room temperature to an elevated temperature of about 240° C. The mandrel and resist are then held at the elevated temperature for about 30 minutes.

In some cases, it may be desirable to add photoresist layers onto the nonconductive islands to control their slope and further enhance the shape of the islands. Hence, as shown in step 48, if the desired shape has not yet been obtained, steps 40–46 may be repeated to place additional photoresist layers onto the islands. Typically, when additional layers are added, the mask will contain circular regions that are smaller in diameter so that the added layers will be smaller in diameter to assist in producing the domed shape of the islands. As shown in step 50, once the desired shape has been attained, the process ends.

Figure 8:
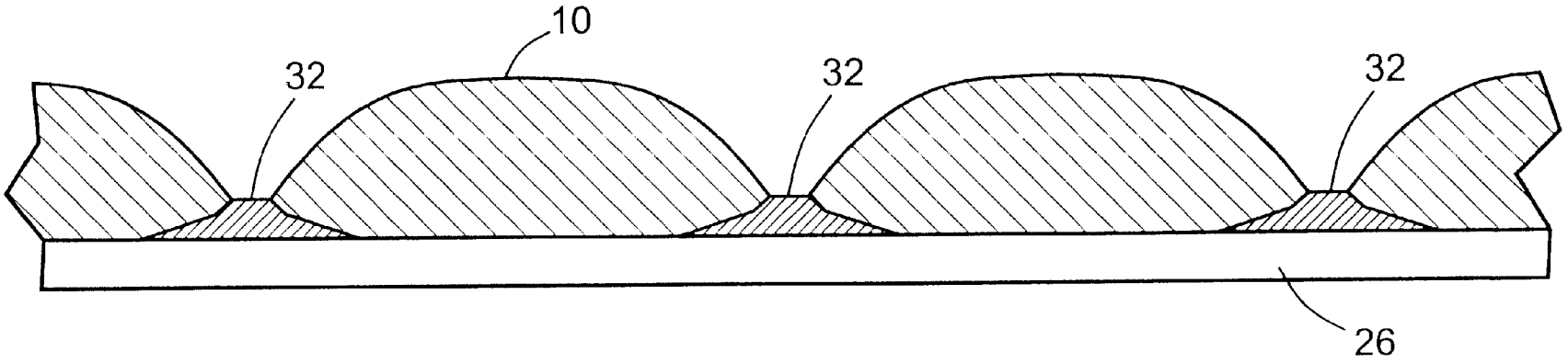
FIG. 8 is a cross-sectional side view of the mandrel of FIG. 5 when used to produce an aperture plate using an electroforming process according to the invention.
Figure 9:
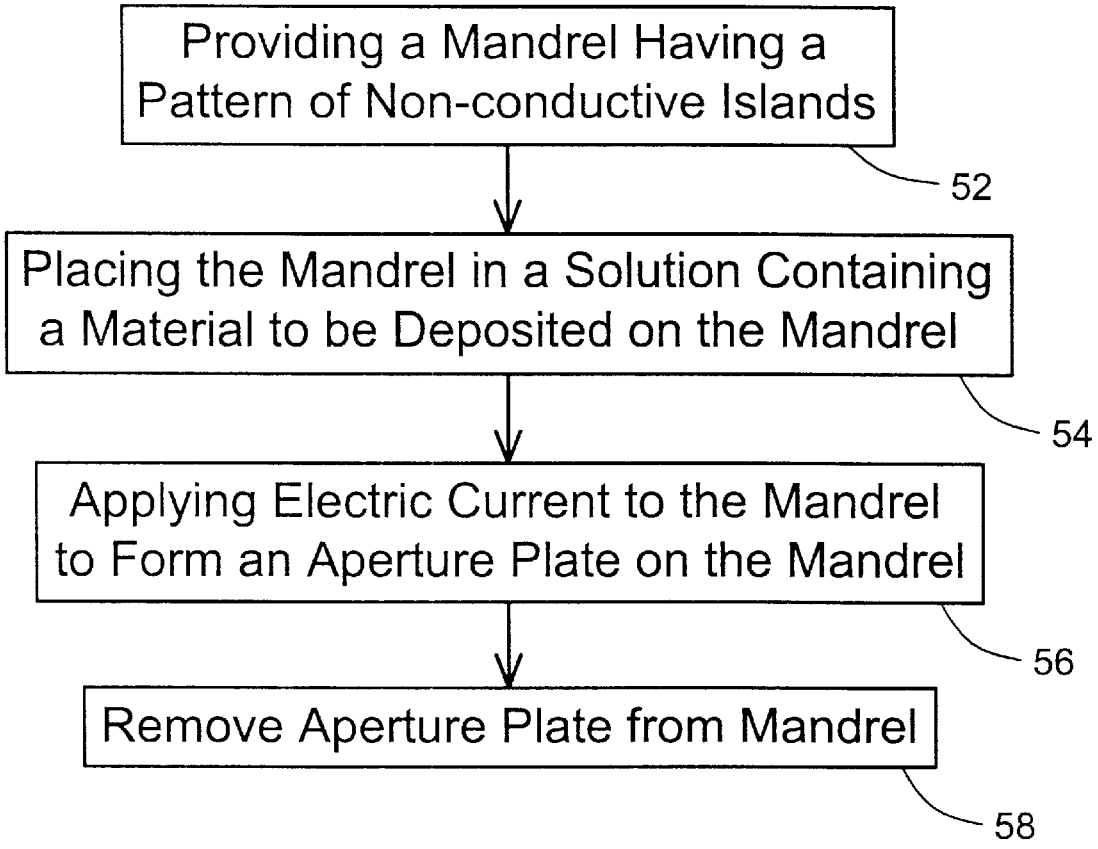
FIG. 9 is flow chart illustrating one method for producing an aperture plate according to the invention.

Referring now to FIGS. 8 and 9, a process for producing aperture plate 10 will be described. As shown in step 52 of FIG. 9, a mandrel having a pattern of nonconductive islands is provided. Conveniently, such a mandrel may be mandrel 26 of FIG. 5 as illustrated in FIG. 8. The process then proceeds to step 54 where the mandrel is placed in a solution containing a material that is to be deposited on the mandrel. As one example, the solution may be a Pallatech PdNi plating solution, commercially available from Lucent Technologies, containing a palladium nickel that is to be deposited on mandrel 26. As shown in step 56, electric current is supplied to the mandrel to electro deposit the material onto mandrel 26 and to form aperture plate 10. As shown in step 56, once the aperture plate is formed, it may be peeled off from mandrel 26.

To obtain the desired exit angle and the desired exit opening on aperture plate 10, the time during which electric current is supplied to the mandrel may be varied. Further, the type of solution into which the mandrel is immersed may also be varied. Still further, the shape and angle of islands 32 may be varied to vary the exit angle of the apertures as previously described. Merely by way of example, one mandrel that may be used to produce exit angles of about 45° is made by depositing a first photoresist island having a diameter of 100 microns and a height of 10 microns. The second photoresist island may have a diameter of 10 microns and a thickness of 6 microns and is deposited on a center of the first island. The mandrel is then heated to a temperature of 200° C. for 2 hours.

Figure 10:
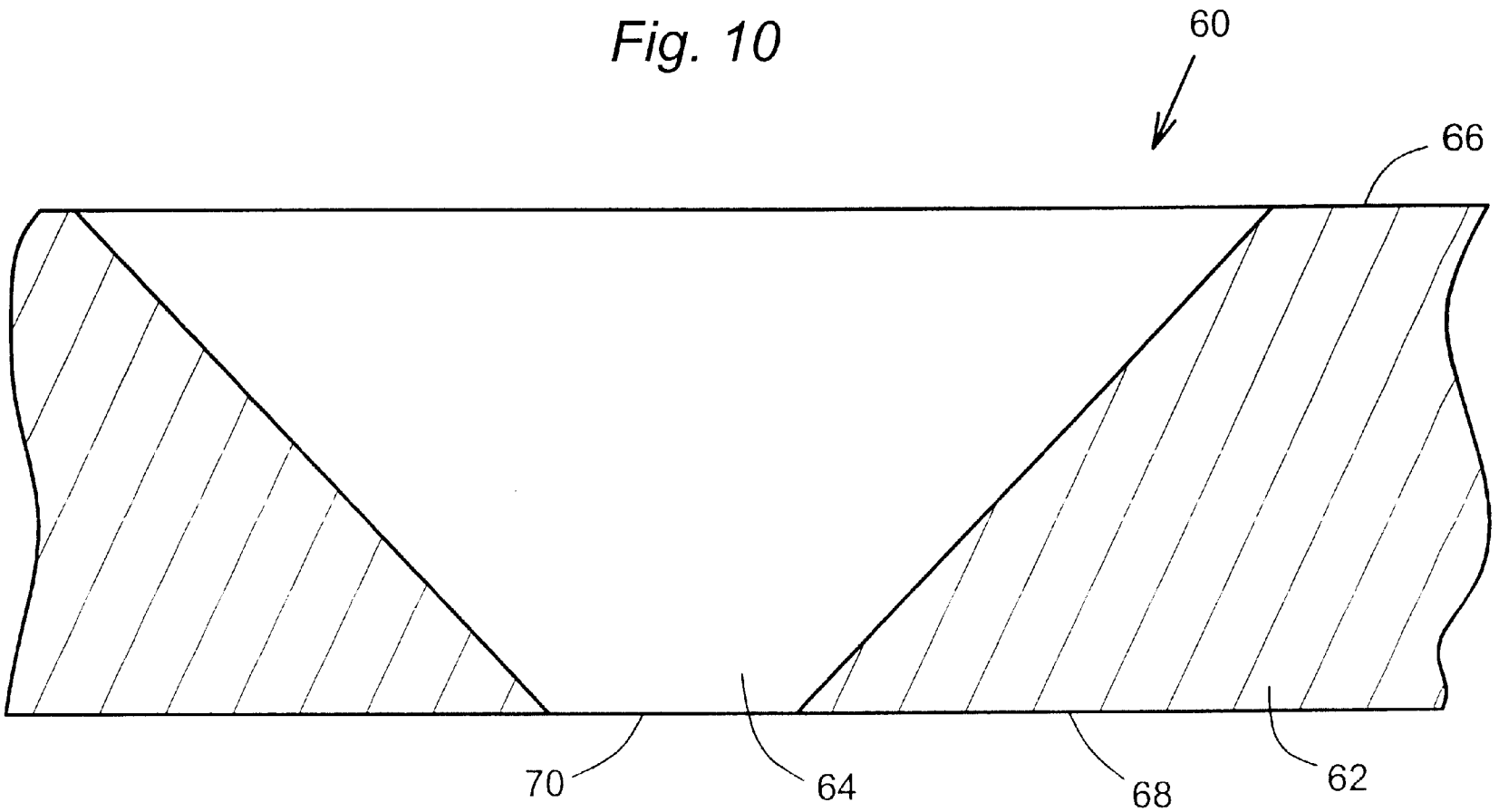
FIG. 10 is a cross-sectional side view of a portion of an alternative embodiment of an aperture plate according to the invention.

Referring now to FIG. 10, an alternative embodiment of an aperture plate 60 will be described. Aperture plate 60 comprises a plate body 62 having a plurality of tapered apertures 64 (only one being shown for convenience of illustration). Plate body 62 has a rear surface 66 and a front surface 68. Apertures 64 are configured to taper from rear surface 66 to front surface 68. As shown, aperture 64 has a constant angle of taper. Preferably, the angle of taper is in the range from about 30° to about 60°, more preferably about 41° to about 49°, and most preferably at about 45°. Aperture 64 further includes an exit opening 70 that may have a diameter in the range from about 2 microns to about 10 microns.

Figure 11:
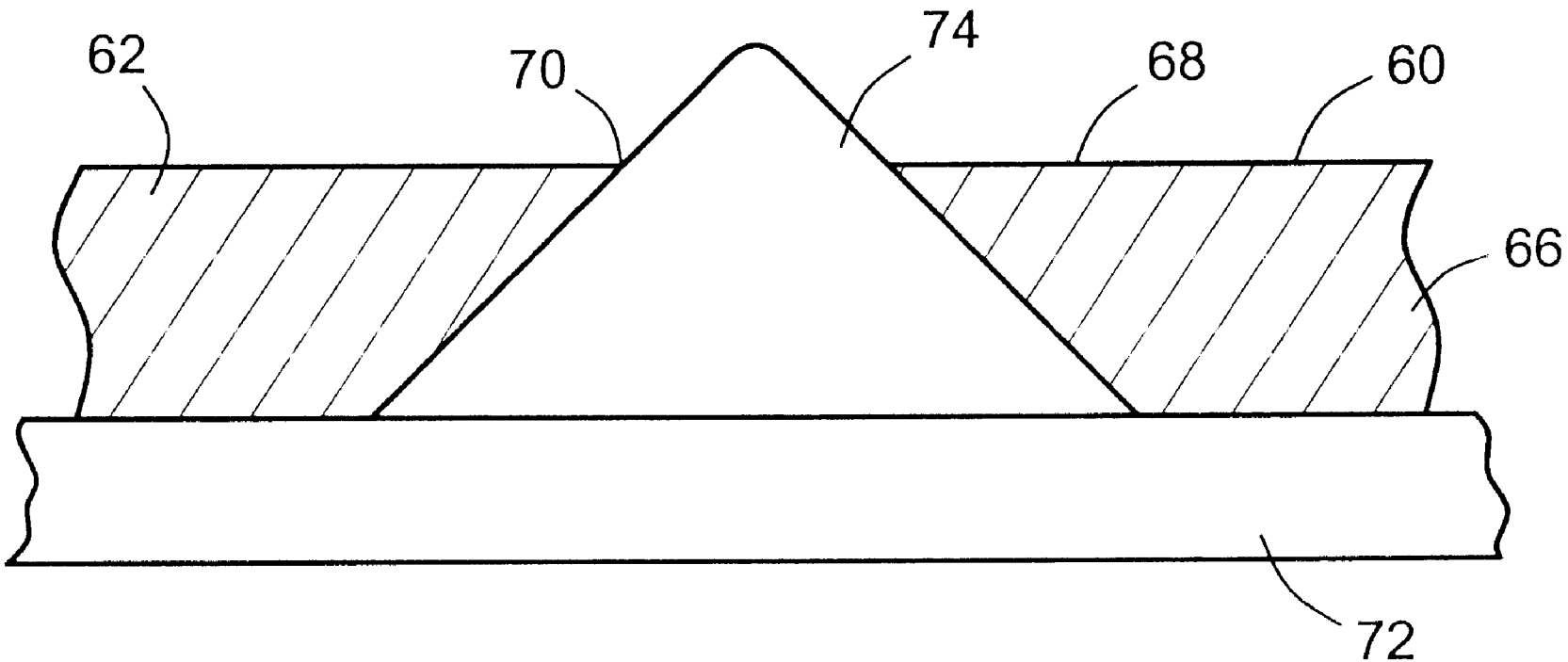
FIG. 11 is a side view of a portion of an alternative electroforming mandrel when used to form the aperture plate of FIG. 10 according to the invention.

Referring to FIG. 11, one method that may be employed to construct aperture plate 62 will be described. The process employs the use of an electroforming mandrel 72 having a plurality of non-conductive islands 74. Conveniently, island 74 may be constructed to be generally conical or domed-shaped in geometry and may be constructed using any of the processes previously described herein. To form aperture plate 60, mandrel 72 is placed within a solution and electrical current is applied to mandrel 72. The electroplating time is controlled so that front surface 68 of aperture plate 60 does not extend above the top of island 74. The amount of electroplating time may be controlled to control the height of aperture plate 60. As such, the size of exit openings 72 may be controlled by varying the electroplating time. Once the desired height of aperture plate 60 is obtained, electrical current is ceased and mandrel 72 may be removed from aperture plate 60.

Figure 12:
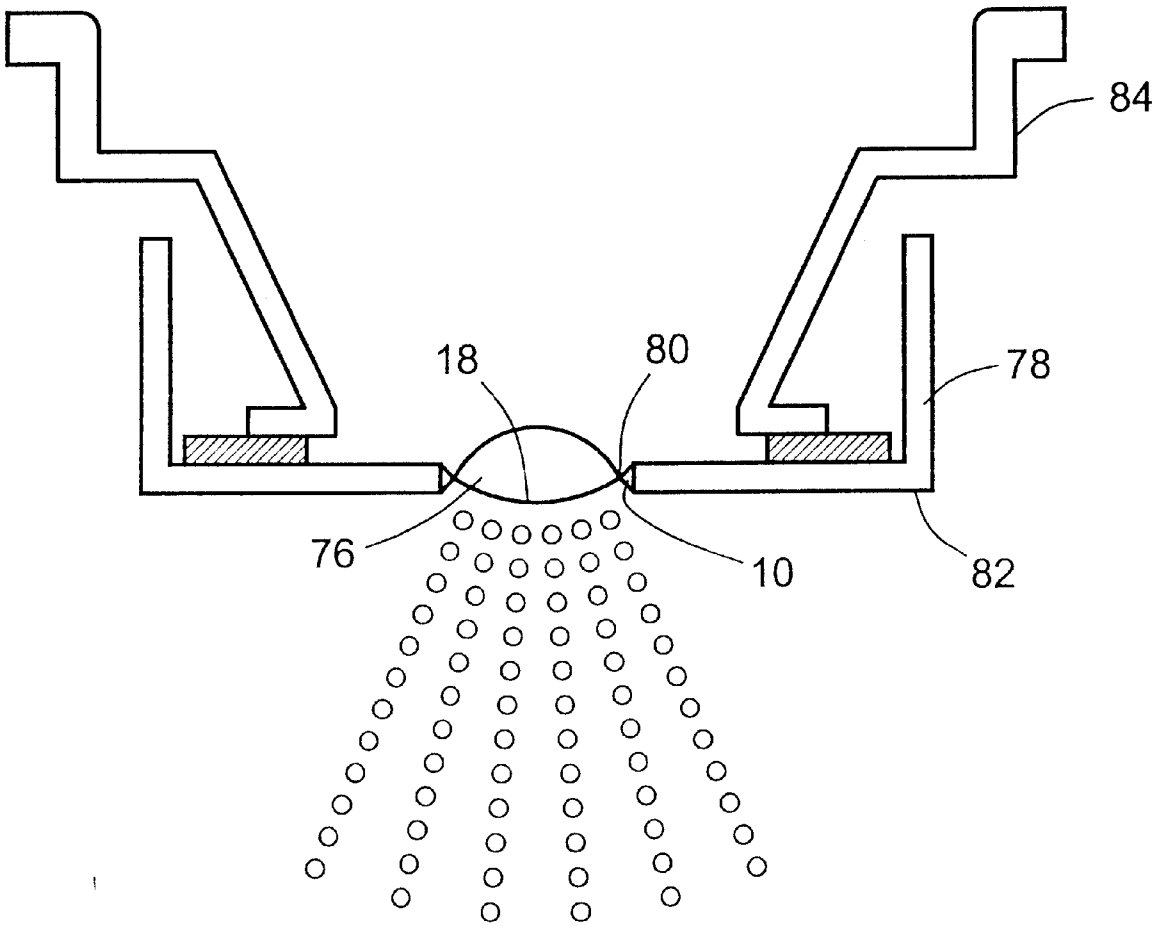
FIG. 12 illustrates the aperture plate of FIG. 1 when used in an aerosol generator to aerosolize a liquid according to the invention.

Referring now to FIG. 12, use of aperture plate 10 to aerosolize a volume of liquid 76 will be described. Conveniently, aperture plate 10 is coupled to a cupped shaped member 78 having a central opening 80. Aperture plate 10 is placed over opening 80, with rear surface 18 being adjacent liquid 76. A piezoelectric transducer 82 is coupled to cupped shaped member 78. An interface 84 may also be provided as a convenient way to couple the aerosol generator to other components of a device. In operation, electrical current is applied to transducer 82 to vibrate aperture plate 10. Liquid 76 may be held to rear surface 18 of aperture plate 10 by surface tension forces. As aperture plate 10 is vibrated, liquid droplets are ejected from the front surface as shown.

As previously mentioned, aperture plate 10 may be constructed so that a volume of liquid in the range from about 4 microliters to about 30 microliters may be aerosolized within a time that is less than about one second per about 1000 apertures. Further, each of the droplets may be produced such that they have a respirable fraction that is greater than about 90 percent. In this way, a medicament may be aerosolized and then directly inhaled by a patient.

The invention has now been described in detail for purposes of clarity of understanding. However, it will be appreciated that certain changes and modifications may be practiced within the scope of the appended claims.

What is claimed is:

1. A method for forming an aperture plate, the method comprising:

providing a mandrel comprising a plate body having a conductive surface and a plurality of non-conductive islands disposed on the conductive surface, wherein the islands extend above the conductive surface and have a slope relative to the conductive surface;

placing the mandrel within a solution containing a material that is to be deposited onto the mandrel;

applying electrical current to the mandrel to form an aperture plate on the mandrel, wherein the apertures have an exit angle that is in the range from about 30° to about 60°, and wherein the exit angle is at least partially dependent upon the slope.

2. A method as in claim 1, wherein the islands have a geometry that approaches a generally conical shape, and wherein the islands have a base diameter in the range from about 20 microns to about 200 microns and a height in the range from about 4 microns to about 20 microns.

3. A method as in claim 1, wherein the islands have an average slope in the range from about 15° to about 30° relative to the conductive surface.

4. A method as in claim 3, further comprising forming the islands from a photoresist material using a photolithography process.

5. A method as in claim 4, further comprising treating the islands following the photolithography process to alter the shape of the islands.

6. A method as in claim 5, wherein the treating the islands comprises heating the islands.

7. A method as in claim 1, further comprising removing the deposited aperture plate from the mandrel and forming a dome shape in the aperture plate.

8. A method as in claim 1, wherein the material in the solution is selected from a group of materials consisting of palladium, palladium nickel, and palladium alloys.

9. A method as in claim 1, wherein the apertures have an exit angle that is in the range from about 41° to about 49°.

10. An aperture plate formed according to the process of claim 1.

11. A mandrel for forming an aperture plate, the mandrel comprising:

a mandrel body having a conductive, generally flat top surface and a plurality of non-conductive islands disposed on the conductive surface, wherein the islands extend above the conductive surface and have a geometry approaching a general cone shape, the shape operable to at least partially define an exit angle of an aperture plate.

12. A mandrel as in claim 11, wherein the islands have a base diameter in the range from about 20 microns to about 200 microns, a height in the range from about 4 microns to about 20 microns.

13. A mandrel as in claim 11, wherein the islands are formed from a photoresist material using a photolithography process.

14. A method as in claim 13, wherein the islands are treated using a treatment following the photolithography process to alter the shape of the islands.

15. A method as in claim 14, wherein the treatment comprises heating the mandrel.

16. A method for forming an aperture plate, the method comprising:

providing a mandrel comprising a plate body having a conductive surface;

forming a non-conductive island on the conductive surface, wherein the island is formed using a photolithography process and an additional treatment to alter the shape of the island;

placing the mandrel within a solution containing a material that is to be deposited onto the mandrel;

applying electrical current to the mandrel to form an aperture plate on the mandrel, wherein the apertures have an exit angle that is in the range from about 30° to about 60°.

17. A method as in claim 16, wherein the island extends above the conductive surface and has a slope relative to the conductive surface.

18. A method as in claim 17, wherein the exit angle is at least partially defined by the slope.

19. A method as in claim 16, wherein the additional treatment comprises heating the mandrel.

20. A method as in claim 16, wherein the island is a first island and the treatment comprises forming a second island on the first island, wherein a diameter of the second island is smaller than a diameter of the first island.

21. A method as in claim 20, wherein the method further comprises heating the mandrel to cause the first island to flow into a desired shape.

* * * * *